US009578955B2

(12) United States Patent
Kim et al.

(10) Patent No.: US 9,578,955 B2
(45) Date of Patent: Feb. 28, 2017

(54) FOLDABLE BRUSH FOR COSMETIC CONTAINER

(71) Applicant: AMOREPACIFIC CORPORATION, Seoul (KR)

(72) Inventors: Joon Young Kim, Seoul (KR); Se Jin Yoon, Seoul (KR)

(73) Assignee: AMOREPACIFIC CORPORATION, Seoul (KR)

( * ) Notice: Subject to any disclaimer, the term of this patent is extended or adjusted under 35 U.S.C. 154(b) by 184 days.

(21) Appl. No.: 14/440,716

(22) PCT Filed: Oct. 13, 2013

(86) PCT No.: PCT/KR2013/009180

§ 371 (c)(1),
(2) Date: May 5, 2015

(87) PCT Pub. No.: WO2014/069816

PCT Pub. Date: May 8, 2014

(65) Prior Publication Data

US 2015/0296964 A1 Oct. 22, 2015

(30) Foreign Application Priority Data

Nov. 5, 2012 (KR) ..... 20-2012-0010065 U

(51) Int. Cl.
*A46B 5/00* (2006.01)
*A46B 9/02* (2006.01)

(52) U.S. Cl.
CPC ..... *A46B 5/0041* (2013.01); *A46B 5/0016* (2013.01); *A46B 9/021* (2013.01)

(58) Field of Classification Search
CPC ... A46B 5/0041; A46B 5/0016; A46B 5/0004; A46B 5/0033; A46B 2200/1046
(Continued)

(56) References Cited

U.S. PATENT DOCUMENTS

2006/0064832 A1* 3/2006 Caramico ..... A46B 5/0033 15/106

FOREIGN PATENT DOCUMENTS

DE 9107530 * 12/1991 ..... A46B 5/0033
JP 08-154726 A 6/1996
(Continued)

*Primary Examiner* — Laura C Guidotti
(74) *Attorney, Agent, or Firm* — Rabin & Berdo, P.C.

(57) ABSTRACT

A foldable brush for a cosmetic container includes a first brush body having a receiving hole, and a second brush body inserted into the receiving hole of the first brush body, wherein the first brush body includes a first brush including a lot of hair as a cosmetic brush; a first brush support for fixing the first brush and maintaining a fixing state of the first brush such that the first brush does not come off the first brush support; a guide body having a semi-cylindrical shape and a receiving hole, and connected to the first brush support; guide holes formed in both side surfaces of the guide body and having an L-shape; and a temporary fixing stopper formed in a lower end portion of the guide body and having a protrusion shape, and wherein the second brush body includes a second brush including a lot of hair as a cosmetic brush; a second brush support for fixing the second brush and maintaining a fixing state of the second brush such that the second brush does not come off the second brush support; a supporting body having a cylindrical shape, one side connected to the second brush support and an opposite side having a hemispherical shape; sliding hinge pins formed in both side surfaces of the supporting body and coupled to the guide holes of the first brush body such that a rotation of the supporting body is supported; and temporary fixing grooves formed in upper and lower portions of the supporting body, respectively and coupled to a temporary fixing stopper of the first brush body to allow the second brush to be maintained in a folded or unfolded state.

4 Claims, 8 Drawing Sheets

(58) Field of Classification Search
USPC ..... 15/106
See application file for complete search history.

(56) References Cited

FOREIGN PATENT DOCUMENTS

| | | | |
|---|---|---|---|
| KR | 20-0406850 | Y1 | 1/2006 |
| KR | 20-0442172 | Y1 | 10/2008 |
| KR | 10-1006908 | B1 | 1/2011 |

* cited by examiner

FOLDABLE BRUSH FOR COSMETIC CONTAINER

BACKGROUND OF THE INVENTION

1. Field of the Invention

The present invention relates to a foldable brush for a cosmetic container, and more particularly, to a foldable brush for a cosmetic container in which two brushes having mutually different types are folded or unfolded with respect to each other and one brush is inserted into an inserting hole formed in the other brush to allow the brushes to be easily maintained in the folded or unfolded state, so that the foldable brush is easily carried and conveniently used.

2. Description of the Related Art

Generally, there are various types of cosmetics and makeup tools used to wear color makeup.

The makeup tools are manufactured according to cosmetics such that the cosmetics are suitably used.

Although there is a makeup tool which may be put in a cosmetic case among the makeup toots manufactured to be suitably used according to cosmetics, a makeup tool, which is used for a cosmetic applied onto skin through touch, such as face powder used to allow a face to look bright, blusher used to allow a face to look colorful as well as better, or eye shadow applied on the eyelids to add dimension to one's eye, has a size which is not suitable to be put in a cosmetic case since the makeup tool is used to apply makeup in a large area.

Thus, the makeup tools are used suitably to cosmetics and are kept in their cases according to the sizes.

As described above, when a makeup tool is kept in a separated keeping case, since a size of the keeping case is large, it is difficult to carry the keeping case when going out. In addition, since the keeping cases are used individually, the cost is increased.

Specifically, since a makeup artist engaging in an occupation of makeup uses many various kinds of brushes, he requests more simply portable makeup brushes.

Meanwhile, to solve the above problems, Korean Utility Model Registration No. 20-0442172 discloses a portable makeup brush by which a user can carry various sizes of brushes. Looking into the technical characteristics of the portable makeup brush, as shown in FIG. 1, the makeup brush is used for wearing makeup by allowing the brush to touch skin after getting a powder type cosmetic on the brush and has various sizes. The makeup brush 10*a* or 10*b* includes a brush body 11*a* or 11*b* having a keeping groove 12*a* or 12*b* in which a small size of makeup brush 10*b* or 10*c* is kept.

However, it is difficult to use two makeup brushes at the same time.

That is, although separated makeup brushes are provided, since a small makeup brush is embedded in a large makeup brush, it is inconvenient to separate the embedded makeup brushes from each other for use.

SUMMARY OF THE INVENTION

Accordingly, the present invention has been made keeping in mind the above problems occurring in the prior art, and an object of the present invention is to a foldable makeup brush in which makeup brushes for mutually different cosmetics are formed by using a single body, are maintained in a folded state when not used, and are unfolded for use.

To achieve the object, according to the present invention, there is provided a foldable brush for a cosmetic container.

The foldable brush includes a first brush body having a receiving hole, and a second brush body inserted into the receiving hole of the first brush body, wherein the first brush body includes a first brush including a lot of hair as a cosmetic brush; a first brush support for fixing the first brush and maintaining a fixing state of the first brush such that the first brush does not come off the first brush support; a guide body having a semi-cylindrical shape and a receiving hole, and connected to the first brush support; guide holes formed in both side surfaces of the guide body and having an L-shape; and a temporary fixing stopper formed in a lower end portion of the guide body and having a protrusion shape, and wherein the second brush body includes a second brush including a lot of hair as a cosmetic brush; a second brush support for fixing the second brush and maintaining a fixing state of the second brush such that the second brush does not come off the second brush support; a supporting body having a cylindrical shape, one side connected to the second brush support and an opposite side having a hemispherical shape; sliding hinge pins formed in both side surfaces of the supporting body and coupled to the guide holes of the first brush body such that a rotation of the supporting body is supported; and temporary fixing grooves formed in upper and lower portions of the supporting body, respectively and coupled to a temporary fixing stopper of the first brush body to allow the second brush to be maintained in a folded or unfolded state.

The foldable brush further includes a sliding cover installed in the first brush body to cover the second brush.

The foldable brush further includes a withdrawing groove formed in an upper portion of the guide body of the first brush body and having an arc shape.

The foldable brush further includes a withdrawing protrusion formed in a side surface of the supporting body of the second brush body to induce the second brush body to be easily withdrawn by manually releasing the second brush body when the second brush body is withdrawn from the first brush body.

BRIEF DESCRIPTION OF THE DRAWINGS

FIG. 4 is a perspective view showing a fixed state of the second brush body to explain an operation of an embodiment of the present invention.

DETAILED DESCRIPTION OF THE INVENTION

Figure 1:
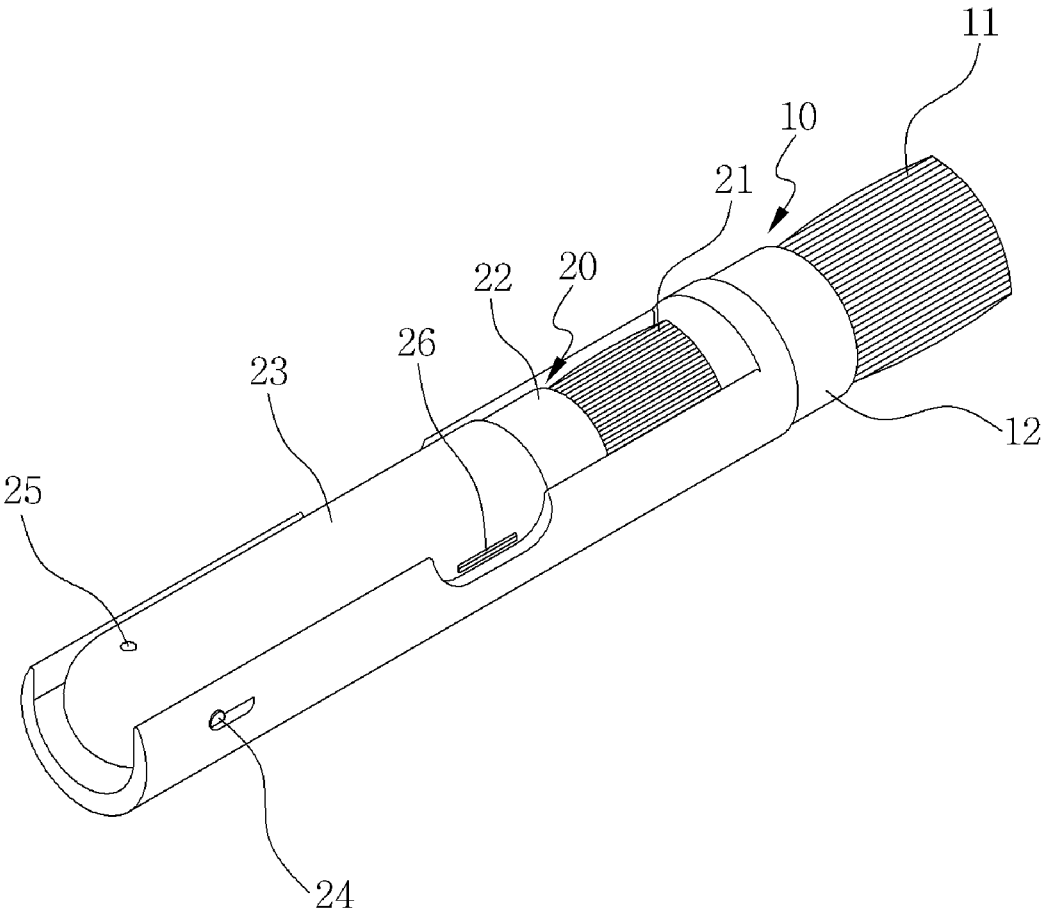
FIG. 1 is a perspective view showing a folded state of a foldable brush for a cosmetic container having two brush bodies according to an embodiment of the present invention.

Hereinafter, exemplary embodiments of the present invention will be described with reference to the accompanying drawings. In the following description, the same elements will be designated by the same reference numerals although they are shown in different drawings. Further, in the following description of the present invention, a detailed description of known functions and configurations incorporated herein will be omitted when it may make the subject matter of the present invention rather unclear.

Further, the following terms are those defined, considering the functions of the present invention, and may be changed according to the intentions of the user or the manager or the customs. Therefore, the definitions of the terms should be made based on the contents of the specification.

FIG. 1 is a perspective view showing a folded state of a foldable brush for a cosmetic container having two brush bodies according to an embodiment of the present invention.

Figure 2:
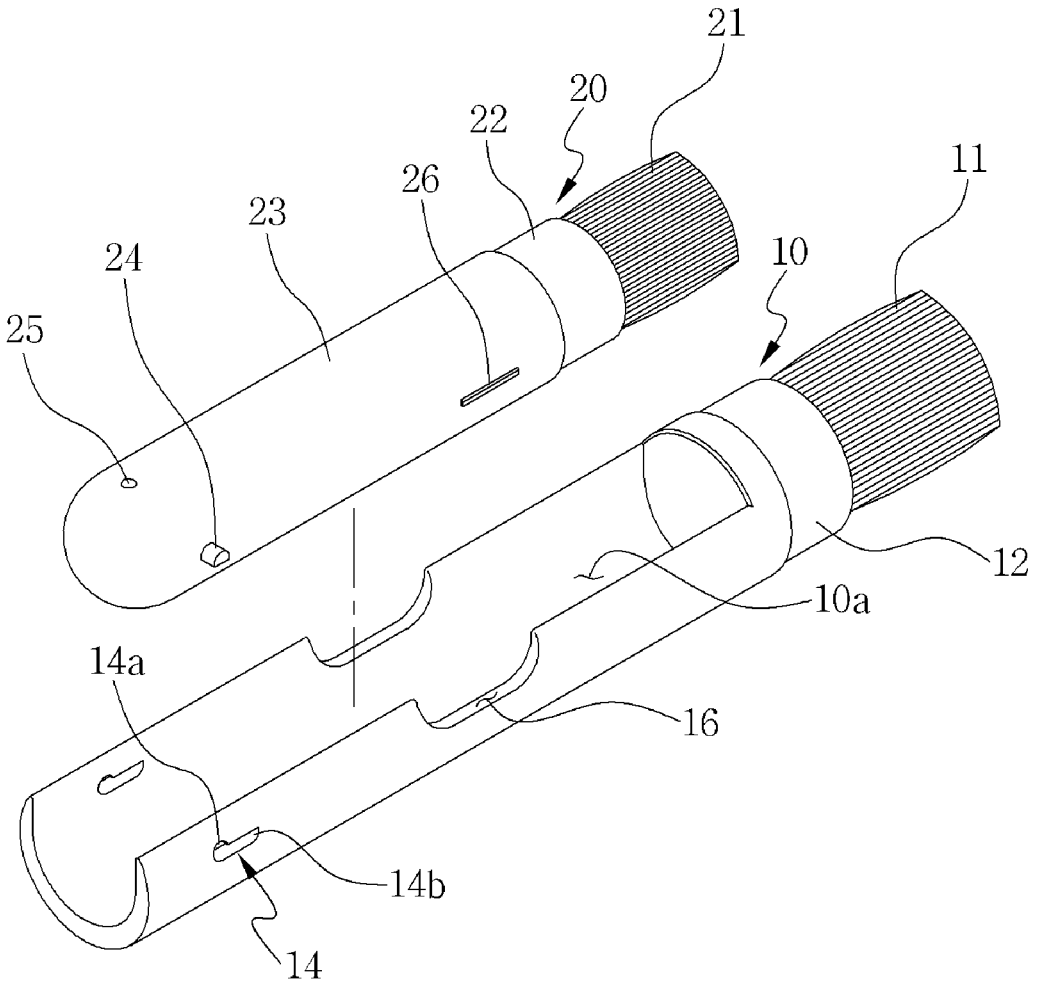
FIG. 2 is an exploded perspective view showing the two brush bodies separated from each other according to an embodiment of the present invention.

FIG. 2 is an exploded perspective view showing the two brush bodies separated from each other according to an embodiment of the present invention.

Figure 3:
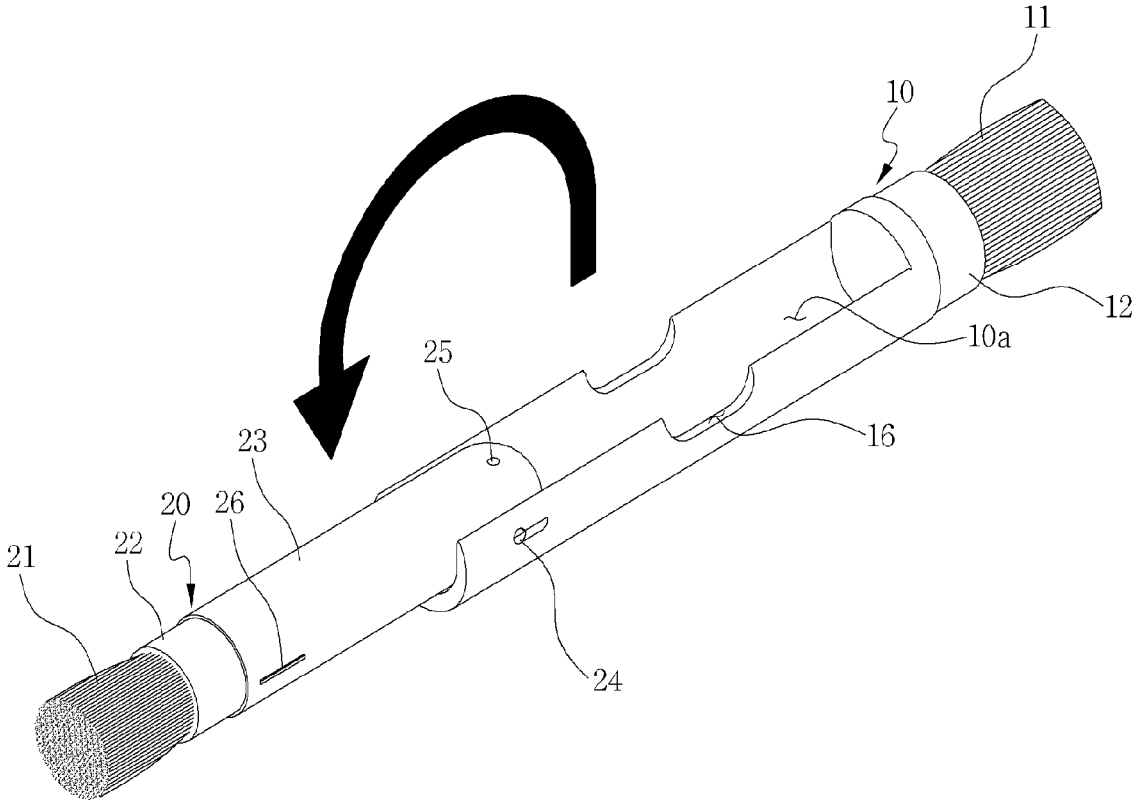
FIG. 3 is a perspective view showing an unfolded state of a second brush body of the foldable brush to explain an operation of an embodiment of the present invention.

FIG. 3 is a perspective view showing an unfolded state of a second brush body of the foldable brush to explain an operation of an embodiment of the present invention.

Figure 4:
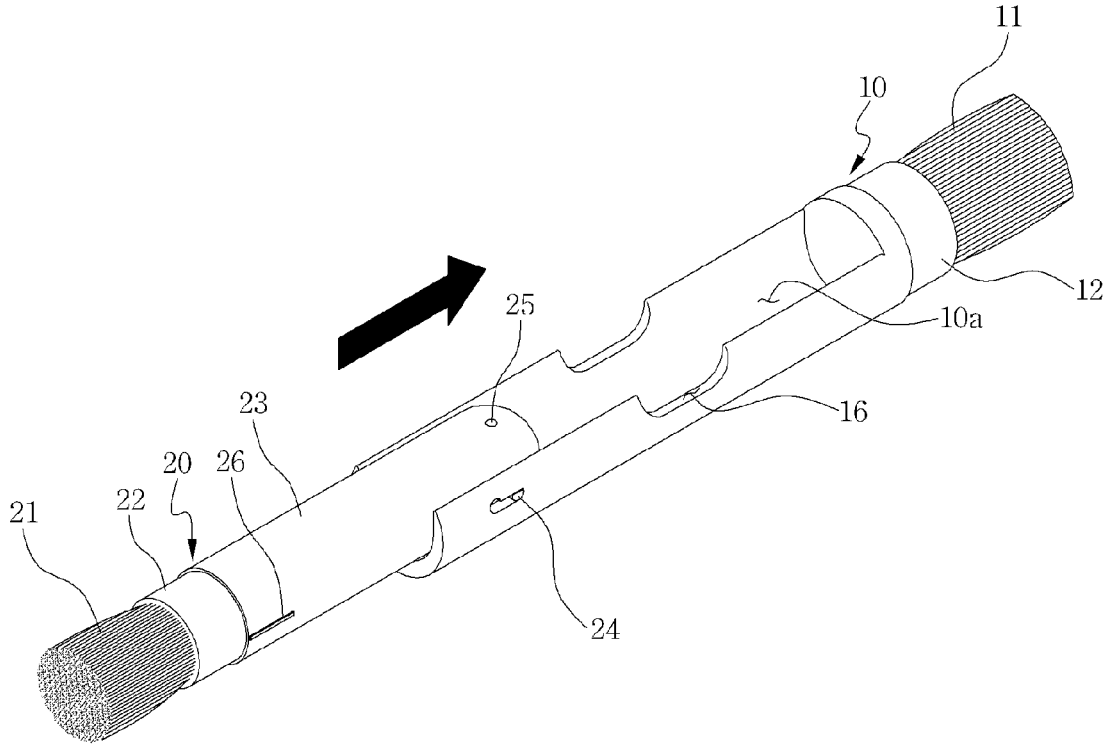
FIG. 4 is

FIG. 4 is FIG. 4 is a perspective view showing a fixed state of the second brush body to explain an operation of an embodiment of the present invention.

Figure 5:
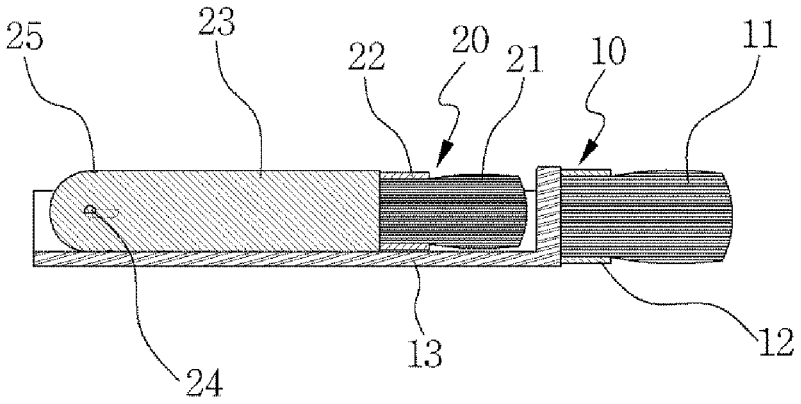
FIG. 5 is a sectional view showing the two brush bodies folded to each other.

FIG. 5 is a sectional view showing the two brush bodies folded to each other.

Figure 6:
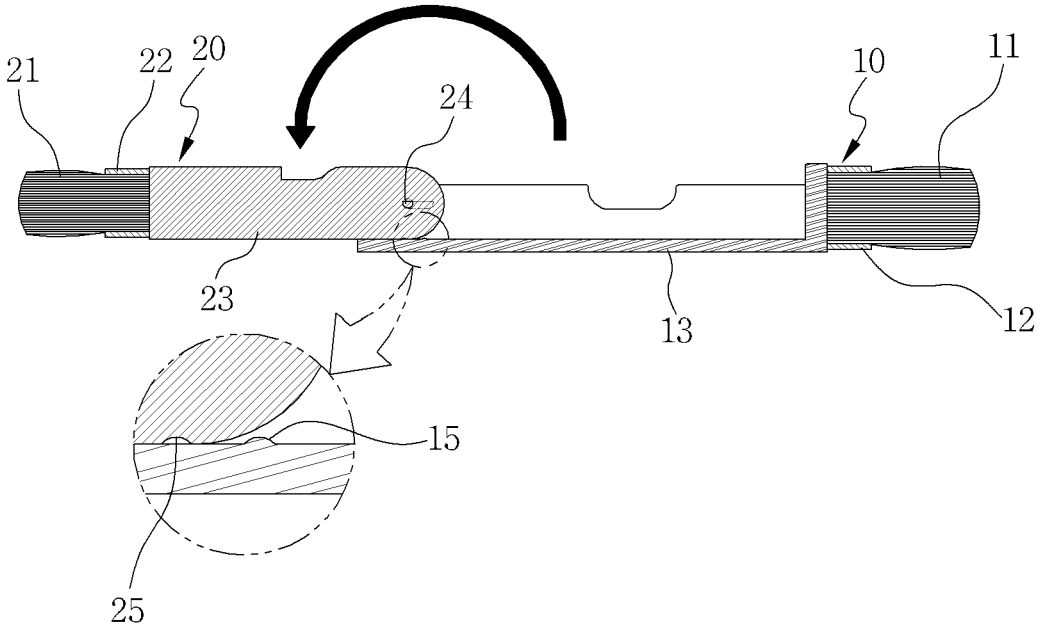
FIG. 6 is a sectional view showing the foldable brush in which the second brush body is unfolded to explain an operation of an embodiment of the present invention.

FIG. 6 is a sectional view showing the foldable brush in which the second brush body is unfolded to explain an operation of an embodiment of the present invention.

Figure 7:
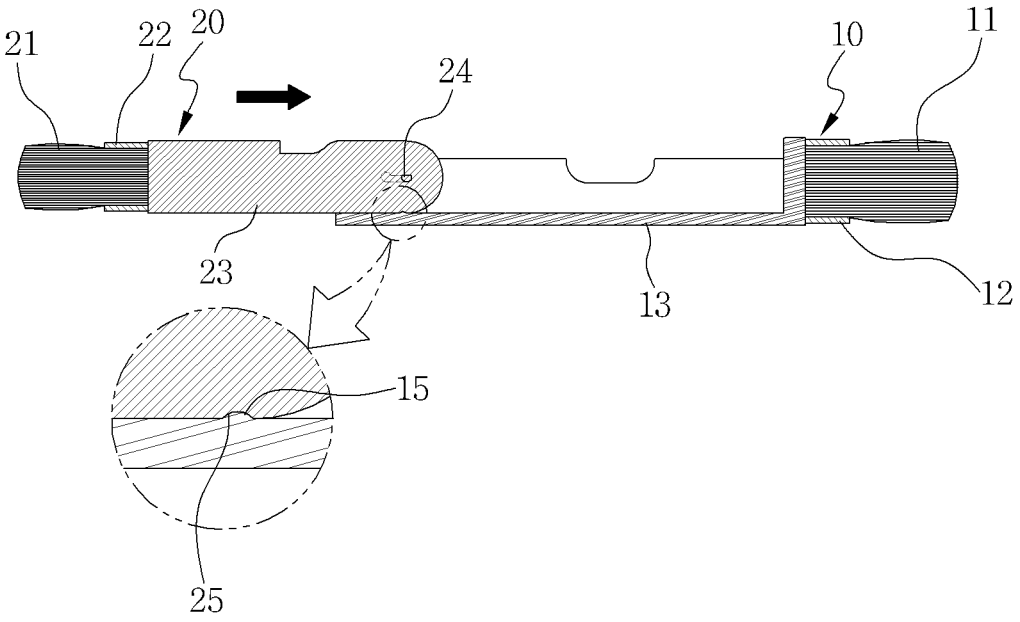
FIG. 7 is a sectional view showing the foldable brush in which the second brush body is unfolded in a shape of a straight line to explain an operation of an embodiment of the present invention.

FIG. 7 is a sectional view showing the foldable brush in which the second brush body is unfolded in a shape of a straight line to explain an operation of an embodiment of the present invention.

Figure 8:
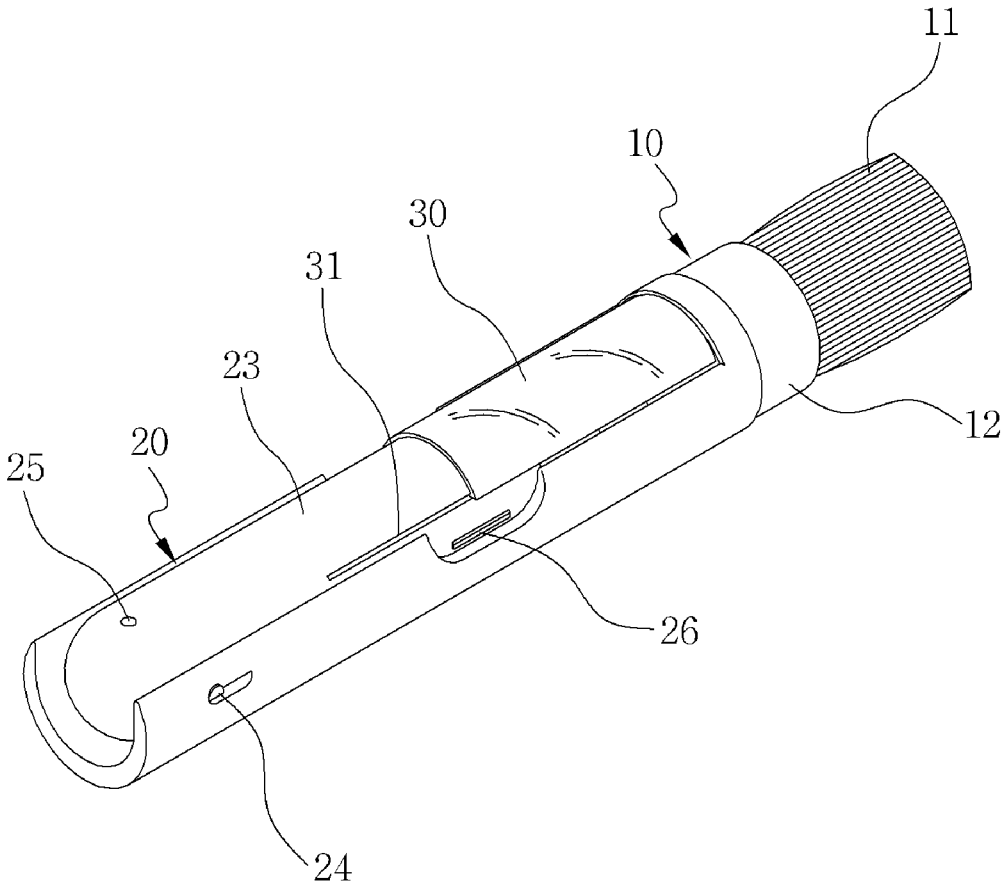
FIG. 8 is a perspective view showing the foldable brush having a sliding cover according to an embodiment of the present invention.

FIG. 8 is a perspective view showing the foldable brush having a sliding cover according to an embodiment of the present invention.

Figure 9:
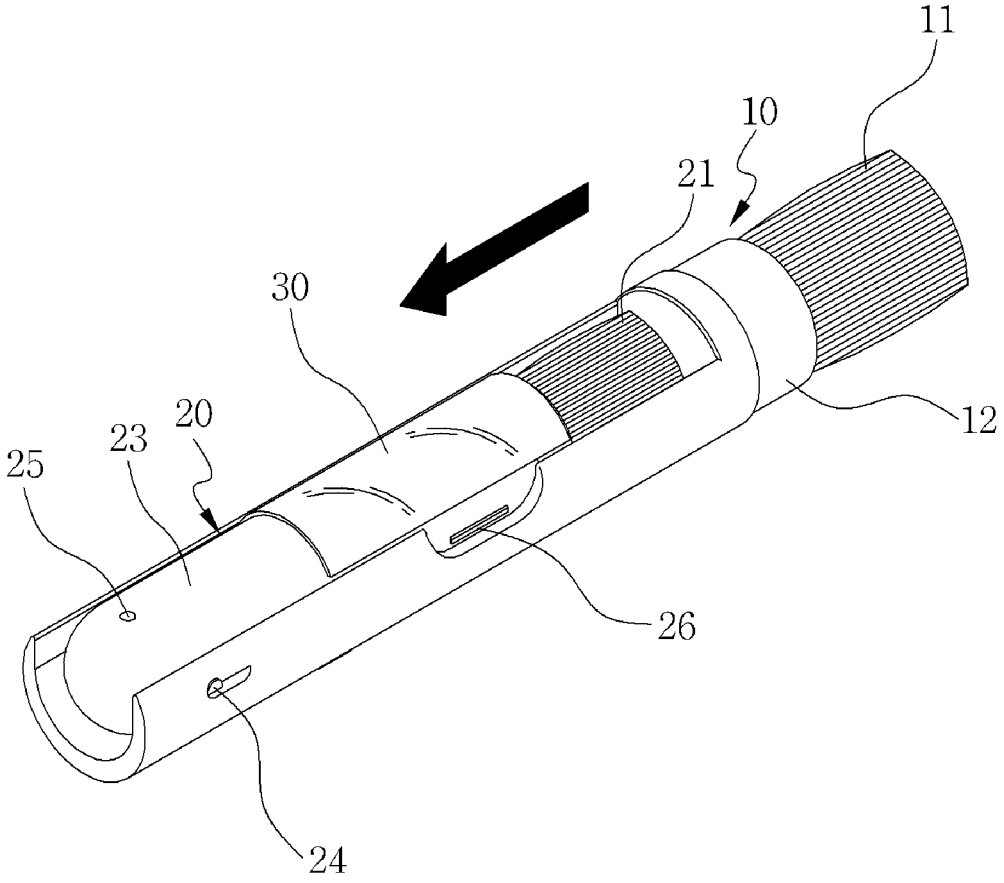
FIG. 9 is a perspective view showing a state of the sliding cover is operation according to an embodiment of the present invention.

FIG. 9 is a perspective view showing a state of the sliding cover is operation according to an embodiment of the present invention.

The foldable brush according to an embodiment of the present invention substantially includes the first and second brush bodies 10 and 20. The first brush body 10 includes a receiving hole 10*a*. In the state that the second brush body 20 is received in the receiving hole 10*a*, the second brush 20 may be folded in or unfolded from the first brush body 10.

The first brush body 10 includes a first brush 11, a first brush support 12, a guide body 13, a guide hole 14, a temporary-fixing stopper 15, and a withdrawing groove 16.

The first brush 11, which is a cosmetic brush, includes a lot of hair. The first brush support 12 for fixing the first brush 11 allows the first brush 11 to be fixed thereto so that the first brush 11 does not come off the first brush support 12.

The guide body 13 has a semi-cylindrical shape and is connected to the first brush support 12, so that the receiving hole 10*a* is formed.

The guide hole 14 is formed in both side surface of the guide body 13 and has an "L"-shape.

The temporary fixing stopper 15 is formed in a lower end portion of the guide body 13 and has a protrusion shape.

The withdrawing groove 16 is formed in an upper portion of the guide body 13 and has an arc shape.

The second brush body 20 includes a second brush 21, a second brush support 22, a supporting body 23, a sliding hinge pin 24 and a temporary fixing groove 25 and a withdrawing protrusion 26.

The second brush 21, which is a cosmetic brush, includes a lot of hair.

The second brush support 22 for fixing the second brush 21 allows the second brush 21 to be fixed thereto so that the second brush 21 does not come off the second brush support 22.

The supporting body 23 has a cylindrical shape. The supporting body 23 includes one side connected to the second brush support 22 and an opposite side having a hemispherical shape.

The sliding hinge pins 24 are formed in both sides of the supporting body 23, respectively. The sliding hinge pin 24 is coupled to the guide hole 14 to support the rotation of the supporting body 23.

The temporary fixing grooves 25 are formed in upper and lower portions of the supporting body 23, respectively. The temporary fixing groove 25 is coupled to the temporary fixing stopper 15 of the first brush body 10 to allow the second brush to be maintained in the folded or unfolded state.

The withdrawing protrusion 26 is formed on the side surface of the supporting body. When the second brush body 20 is manually released from the brush body 10, the withdrawing protrusion 26 induces the second brush body 20 to be easily withdrawn from the first brush body 10.

In addition, a cover may be further provided to protect the second brush. To this end, a guide bar is formed in the supporting body of the second brush and a sliding cover sliding along the guide bar is provided.

Hereinafter the assembly method according to an embodiment of the present invention will be described.

The foldable brush according to an embodiment of the present invention includes the first and second brush bodies 10 and 20. The first brush 11 is coupled to the first brush body 10 and the second brush 21 is coupled to the second brush body 20. The sizes of the first and second brushes 11 and 21 are different from each other.

That is, since the second brush 21 is inserted into the first brush body 10, the second brush 21 has a size smaller than that of the first brush 11.

According to an embodiment of the present invention, the guide body 13 is formed in the first brush body 10 and the second brush body 20 is inserted into the receiving hole 10*a* of the guide body 13.

In addition, the second brush body 20 has the hinge pin 24 corresponding to the guide hole 14 formed in the first brush body 10, so that the second bush body 20 is folded or unfolded with respect to the hinge pin 24.

Further, since the first brush body 10 has the temporary fixing stopper 15 corresponding to the temporary fixing groove 25 of the second brush body 20, the state of folding or unfolding the second brush body 20 may be maintained to provide convenience in use.

In addition, since the first brush body 10 has the withdrawing groove 16 corresponding to the withdrawing protrusion 26 formed in the second brush body 20, when the second brush body 20 is folded in the first brush body 10, the withdrawing protrusion 26 is inserted into the withdrawing groove 16. Then, when the second brush body 20 is withdrawn from the first brush body 10, the withdrawing protrusion 26 is manually released from the withdrawing groove 16, so that the second brush body 20 may be easily withdrawn from the first brush body 10.

Hereinafter the operation of the foldable brush according to an embodiment of the present invention will be described below.

According to an embodiment of the present invention, the second brush body 20 is coupled to the first brush body 10 through the hinge pin 24, so that the state that the second brush body 20 is coupled to the guide body 13 of the first brush body 10 is maintained before using it.

Of course, if necessary, the sliding cover 30 may be allowed to cover the second brush 221 of the second brush body 20 to protect the second brush 21.

Then, when looking into the using operation of the second brush body 20, the second brush body 20 is released by pushing the sliding cover covering the second brush body 20.

Next, the withdrawing protrusion 26 is manually released such that the second brush body 20 is withdrawn from the first brush body 10.

Thus, the hinge pin 24 is rotated around guide hole 14 such that the second brush body 20 is rotated at about 180° about the first brush body 10.

When the second brush body 20 is rotated at about 180°, the second brush body 20 is pushed right such that the hinge pin 24 is tightly coupled to the guide hole 14.

That is, since the guide hole 14 according to an embodiment of the present invention includes a vertical hole 14*a* and a horizontal hole 14*b* so that the guide hole 14 has the L-shape, if the sliding hinge pin 24 is pushed in the state that the sliding hinge pin 24 is positioned in the vertical hole 14*a*, the sliding hinge pin 24 slides into the horizontal hole 14*b*. Thus, the state that the second brush body 20 is tightly coupled to the first brush body 10 while the sliding hinge pin 24 is forcibly and tightly sliding into the horizontal hole 14*b* may be maintained.

Since the temporary fixing stopper 15 is installed in the position at which the second brush body 20 is tightly fastened to the first brush body 10 and the temporary fixing groove 25 is latched to the temporary fixing stopper 15, so that the second brush body 20 is more stably maintained in the state that the second brush body 20 is unfolded. That is, when the temporary fixing groove 25 is advanced, the temporary fixing groove 25 is snap coupled to the temporary fixing stopper 15, so that the second brush body 20 is easily maintained in the state that the second brush body 20 is fixed to the first brush body 10.

As described above, when the second brush body 20 is unfolded about the first brush body 10, a user wears makeup using the first and second brushes 11 and 21 of the first and second brush bodies 10 and 20.

Then, when the makeup is completed, the second brush body 20 is received in the first brush body 10. The receiving process will be described as follows.

The sliding hinge pin 24 escapes from the horizontal hole 14*b* by allowing the second brush body 20 to move left, so that the sliding hinge pin 24 is placed at the vertical hole 14*a*.

Then, the sliding hinge pin 24 is freely movable in the vertical hole 14*a*. In this case, the sliding hinge pin 24 is inserted into the receiving hole 10*a* formed in the guide body 13 of the first brush body 10 by rotating the second brush body 20.

Next, while the sliding hinge pin 24 is moving when the second brush body 20 is pushed right, the second brush body 20 is inserted into the horizontal hole 14*b* of the guide hole 14, so that the temporary fixing stopper 15 is coupled to the temporary groove 25, so the second brush body 20 is maintained in the firmly folded state. That is, the second brush body 20 is prevented from trembling.

Then, as the sliding cover 30 moves along the guide 31 formed in the second brush body 20, the second brush 21 moves together with the sliding cover 30, so that the second brush 21 is protected.

Therefore, according to the present invention, the foldable brush includes two brush bodies 10 and 20, in which the second brush body 20 is easily folded from or unfolded into the first brush body 10. In addition, the folded or unfolded state is easily maintained so that in-use convenience is maximized.

What is claimed is:

1. A foldable brush for a cosmetic container, comprising:

a first brush body (10) having a receiving hole (10*a*), and a second brush body (20) inserted into the receiving hole (10*a*) of the first brush body (10), a first brush (11) including a lot of hair as a cosmetic brush;

a first brush support (12) for fixing the first brush (11) and maintaining a fixing state of the first brush (11) such that the first brush 11 does not come off the first brush support 12;

a guide body (13) having a semi-cylindrical shape and a receiving hole (10*a*), and connected to the first brush support (12);

guide holes (14) formed in both side surfaces of the guide body (13) and having an L-shape; and a temporary fixing stopper (15) formed in a lower end portion of the guide body (13) and having a protrusion shape, and wherein the second brush body (20) comprises:

a second brush (21) including a lot of hair as a cosmetic brush;

a second brush support (22) for fixing the second brush (21) and maintaining a fixing state of the second brush (21) such that the second brush (21) does not come off the second brush support (22);

a supporting body (23) having a cylindrical shape, one side connected to the second brush support (22) and an opposite side having a hemispherical shape;

sliding hinge pins (24) formed in both side surfaces of the supporting body (23) and coupled to the guide holes (14) of the first brush body (10) such that a rotation of the supporting body (23) is supported; and temporary fixing grooves (25) formed in upper and lower portions of the supporting body, respectively and coupled to a temporary fixing stopper (15) of the first brush body (10) to allow the second brush to be maintained in a folded or unfolded state.

2. The foldable brush of claim 1, further comprising a sliding cover (30) installed in the first brush body (10) to cover the second brush.

3. The foldable brush of claim 1, further comprising a withdrawing groove (16) formed in an upper portion of the guide body (13) of the first brush body (10) and having an arc shape.

4. The foldable brush of claim 1, further comprising a withdrawing protrusion (26) formed in a side surface of the supporting body of the second brush body (20) to induce the second brush body to be easily withdrawn by manually releasing the second brush body when the second brush body is withdrawn from the first brush body.

* * * * *